US005611675A

United States Patent [19]

Uchida et al.

[11] Patent Number: 5,611,675

[45] Date of Patent: Mar. 18, 1997

[54] SWASH PLATE COMPRESSOR WITH START UP FLOW RESTRICTIVE INLET SPOOL VALVE

[75] Inventors: Kazuhide Uchida, Hamamatsu; Mikio Matsuda; Mitsuo Inagaki, both of Okazaki; Takeshi Sakai, Chiryu, all of Japan

[73] Assignee: Nippon Soken, Inc., Nishio, Japan

[21] Appl. No.: 450,587

[22] Filed: May 31, 1995

[30] Foreign Application Priority Data

May 31, 1994 [JP] Japan ..... 6-117823

[51] Int. Cl.[6] ..... F04B 7/00

[52] U.S. Cl. ..... 417/270; 417/298; 417/507

[58] Field of Search ..... 417/270, 295, 417/298, 507, 508, 510

[56] References Cited

U.S. PATENT DOCUMENTS

| | | | |
|---|---|---|---|
| 2,881,973 | 4/1959 | Ricardo | 417/298 |
| 2,940,396 | 6/1960 | Misulis | 417/270 |
| 3,319,568 | 5/1987 | Repko et al. | 147/270 |
| 3,648,673 | 3/1972 | Knape | 417/507 |

FOREIGN PATENT DOCUMENTS

| | | | |
|---|---|---|---|
| 155643 | 6/1951 | Australia | 417/270 |
| 1271673 | 10/1989 | Japan . | |

*Primary Examiner*—Timothy Thorpe
*Assistant Examiner*—Roland G. McAndrews, Jr.
*Attorney, Agent, or Firm*—Cushman, Darby & Cushman IP Group of Pillsbury Madison & Sutro LLP

[57] ABSTRACT

A spool 9 is connected to the rotating shaft 1 so that the spool 9 is slidable with respect to the shaft 1, while the rotating movement of the shaft 1 is transmitted to the spool 9. The spool 9 is formed with a first recess 9-3 of a reduced circumferential extension for obtaining a reduced compression capacity and a second recess 9-4 of an increased circumferential extension for obtaining a full capacity of the compressor. An intake pressure is always opened to a side of the spool, while an intermediate chamber is formed on the other side of the spool. A spring 10 is arranged for causing the spool 9 to be moved toward the intermediate pressure chamber. At the instant the compressor is brought into operation, introduction of the intake gas occurs via the first recess 9-4, thereby obtaining a compression capacity of 3 to 5% compared to the full capacity of the compressor.

12 Claims, 9 Drawing Sheets

END OF INTAKE OPERATION

START OF INTAKE OPERATION

END OF INTAKE OPERATION

START OF INTAKE OPERATION

SWASH PLATE COMPRESSOR WITH START UP FLOW RESTRICTIVE INLET SPOOL VALVE

BACKGROUND OF THE INVENTION

1. Field of the Invention

The present invention relates to a swash plate type compressor wherein a swash plate is provided for obtaining a reciprocal movement of pistons. Such a swash plate type compressor can be utilized to compress a refrigerant in a refrigerating system in an air conditioning apparatus for an automobile.

In the present invention, the term swash plate type compressor includes both of a single sided piston type (so called wobble type) where pistons are provided only on one side of a swash plate and a double sided piston type where pistons are provided on both sides of a swash plate.

2. Description of Related Art

A swash plate type compressor for use in a refrigerating system for an air conditioning apparatus for an automobile is connected via a clutch to a crankshaft of an internal combustion engine of the automobile, so that a rotating movement from the crankshaft is transmitted to the compressor. In view of simplicity of construction, the output capacity of the swash plate type compressor is usually fixed. Namely, in a conventional swash plate type compressor, 100% output capacity, which corresponds to the total volume of the piston chambers, is always obtained.

However, in the conventional type of a swash plate type compressor, where 100% output capacity is always obtained, the engagement of the clutch causes the full torque required by the compressor to be instantly applied to the engine when the clutch is engaged for commencing an air conditioning operation, thereby generating a shock in a body of the vehicle.

On the other hand, Japanese Un-Examined Patent Publication No. 5-306680 discloses a swash plate type compressor, with a variable output capacity, which includes a spool (rotary valve) which is slidable with respect to a rotating shaft. The spool can rotate together with respect to the rotating shaft and a control means for controlling an axial position of the spool on the rotating shaft is provided. The control means is, for example, constructed by a control valve for controlling the back pressure on the spool, so that an axial position of the spool is controlled in accordance with the back pressure. The spool is formed with a groove for obtaining a communication of an intake port with the piston chambers. The groove extends axially and has two portions with different circumferential dimensions. In other words, in accordance with the axial movement of the spool by the control device, a step-like change occurs in an circumferential length, where the intake port communicates with the groove. In other words, in accordance with the axial movement of the spool, the length of the period when the intake port communicates with a cylinder chamber, is varied. As a result, in accordance with the axial movement of the spool, the effective volume of the cylinder, i.e., the amount of the gaseous refrigerant introduced into the piston chamber is varied. Namely, when the duration of the communication of the intake port with the cylinder chamber is shortened, the output capacity of the compressor is reduced.

In the compressor of the above mentioned variable output capacity type, it is possible that the output capacity is reduced when the operation of the compressor is commenced. The reduction of the output capacity causes the load applied to the engine to be reduced, thereby reducing, to some extent, the shock generated upon the commencement of the operation of the compressor.

However, the output capacity controllable type compressor was originally designed to provide a two step control of the output capacity of the compressor in accordance with air conditioning load. Namely, a full output capacity is obtained when the air conditioning load is high. Contrary to this, a partial output cavity is obtained, when the air conditioning load is low. Thus, the degree of reduction of the output capacity is as little as 15% of the full capacity in order to maintain a desired amount of flow of lubricant oil introduced into the compressor during the low load condition. Such a small reduction of the output capacity allows only a small reduction in the operating torque to be obtained, causing a shock to be generated when the compressor is started.

Furthermore, the provision of the mechanism for controlling the back pressure on the spool makes the system complicated, on the one hand, and the manufacturing cost to be increased, on the other hand.

SUMMARY OF THE INVENTION

An object of the present invention is to provide a swash plate compressor with a simplified construction which prevents the occurrence of a shock when the operation of the compressor is commenced.

According to the present invention, a swash plate compressor for compressing a gas: comprises a casing having at least one cylinder bore.

A rotating shaft rotatably connects to the casing.

At least one piston is axially slidably inserted to the at least one cylinder bore, so that at least one piston chamber is formed by the at least one piston in the at least one cylinder bore.

A swash plate is fixedly connected to the rotating shaft, so that the swash plate is rotated together with the rotation of the rotating shaft, the swash plate acting in cooperation with the piston so that the rotating movement of the swash plate causes the piston to be axially reciprocated in the cylinder bore, thereby varying the volume of the piston chamber.

A swash plate chamber is disposed in the casing for storing the swash plate.

Intake means introduces the gas into the piston chamber when the piston is moved in a direction for increasing the volume of the piston chamber, and discharge means discharges the gas when the piston is moved in the opposite direction to decrease the volume of the piston chamber.

The intake means comprises:

an intake chamber in the casing for receiving the gas to be compressed.

An intake port is disposed in the casing for connecting the intake chamber with the piston chamber.

A spool valve is rotatably connected with the rotating shaft and is axially slidable with respect to the rotating shaft.

The intake chamber is opened to one side of the spool valve, while, on the other side of the spool valve an intermediate pressure chamber is formed in communication with the swash plate chamber, and a spring urges the spool valve toward the intermediate pressure chamber.

The said spool forms:

a first recess for allowing the intake port to communicate with the intake chamber through a rotating angle corresponding a fraction of an intake stroke of the piston when the spool is moved to a position adjacent the intermediate pressure chamber by the force of the spring due to low pressure in the intermediate pressure chamber.

A second recess formed by the spool allows the intake port to communicate with the intake chamber through a rotating angle range corresponding a full intake stroke of the piston when the spool is moved to a position opposite the intermediate pressure chamber against the force of the spring due to high pressure in the intermediate pressure chamber.

BRIEF DESCRIPTION OF ATTACHED DRAWINGS

DESCRIPTION OF PREFERRED EMBODIMENTS

Figure 1:
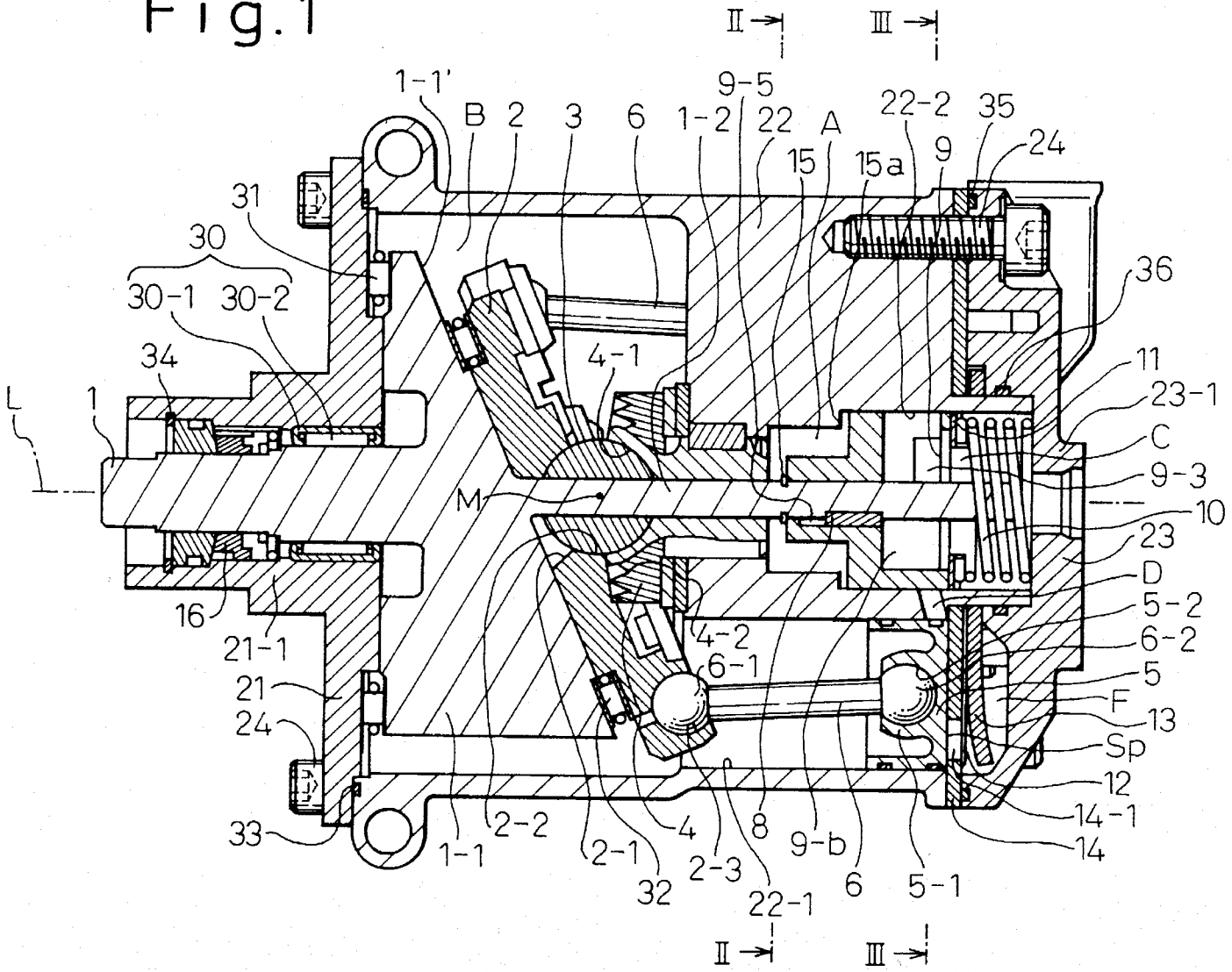
FIG. 1 is a longitudinal cross-sectional view of a swash compressor according to the present invention.
Figure 2:
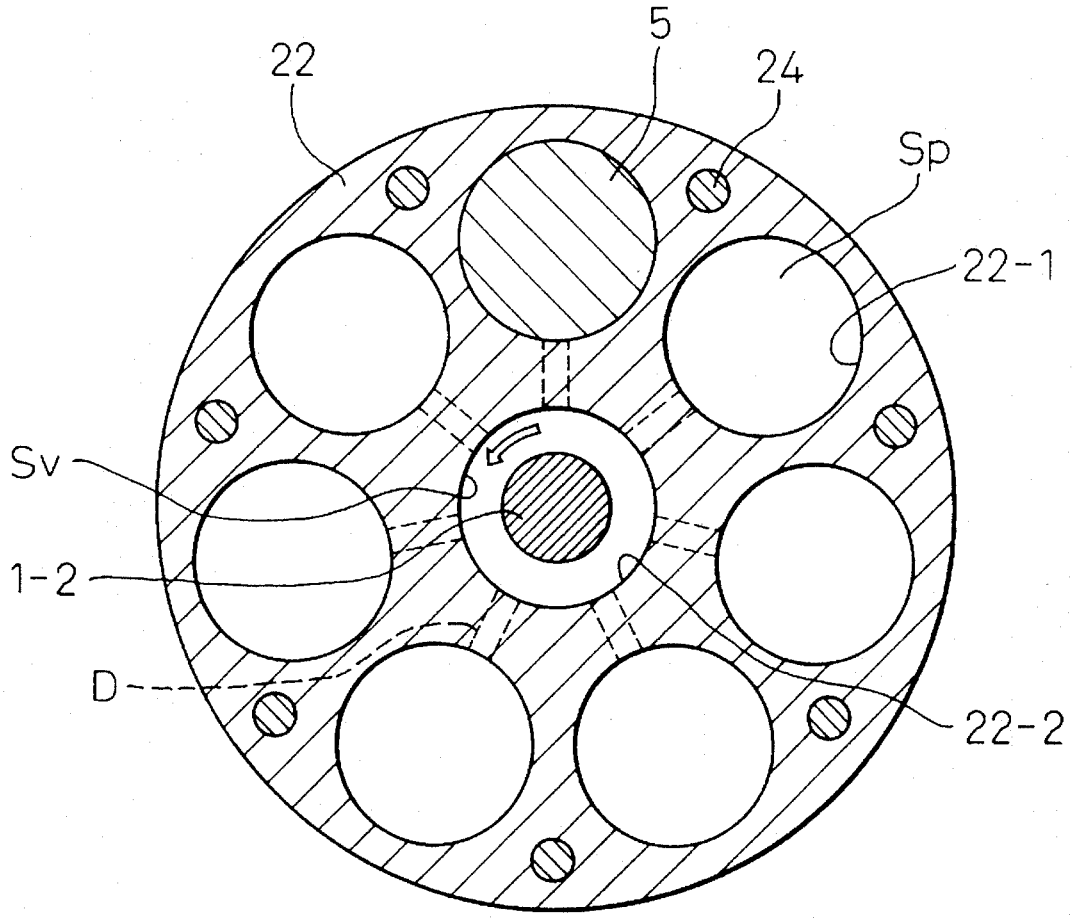
FIG. 2 is a transverse cross-sectional view along a line II—II in FIG. 1.

FIG. 1 shows a first embodiment of a swash plate compressor according to the present invention, which can be suitably used in an air conditioning device for an automobile. The swash plate compressor in FIG. 1 is, usually, called as a wobble type, where pistons are arranged at only one side of a swash plate. The compressor includes a casing assembly constructed by a front casing 21, a central casing or cylinder block 22 and a rear casing 23. The front casing 21 is connected to the cylinder block 22 by means of bolts 24. A seal ring 33 is arranged in an annular groove on an axial end surface of the cylinder block 22 faced with the front casing 21. Similarly, the rear casing 23 is connected and the cylinder block 22 by means of seven bolts 24 which are circumferentially and equiangularly spaced as shown in FIG. 2. A valve seat plate 14 is arranged between the cylinder block 22 and the rear casing 23. A seal ring 35 is arranged in an annular groove on an axial end surface of the rear casing 23 facing the valve seat plate 14. A reference numeral 1 denotes a rotating shaft made of a metal material. The rotating shaft 1 is connectible with an electromagnetic clutch (not shown), which is for a selective transmission of a rotating movement from a rotating source, such as a crankshaft of an internal combustion engine, to the rotating shaft 1.

A swash plate chamber B is formed between the front casing 21 and the cylinder block 22. In the chamber B, a swash plate mechanism is stored. Namely, the rotating shaft 1 is integrally formed with a swash plate 1-1, which is located in the chamber B. The swash plate 1-1 is formed with a small diameter portion 1-2 extending integrally from the swash plate portion 1-1. The swash plate portion 1-1 has a surface 1-1', which extends transversely to a longitudinal axis of the shaft 1, while being inclined with respect to an longitudinal axis of the shaft 1. The front casing 21 has a central boss portion 21-1, to which the rotating shaft 1 is rotatably supported via a radial bearing unit 30, which is constructed by a casing 30-1 and a plurality of circumferentially spaced needles 30-2. A thrust bearing 31 is arranged between the front casing 21 and the swash plate portion 1-1, so that an axially thrust force from the swash plate portion 1-1 is received by the thrust bearing 31. Adjacent the bearing unit 30, a shaft seal unit 16 is arranged on the shaft 1 and fixed in place by means of a circlip 34 fitted to an annular groove of a bore of the front casing 21.

A wobble plate 2 is slidably rested on the inclined surface 1-1' of the swash plate portion 1-1 by way of a thrust bearing 32. Namely, the wobble plate 2 has a central bore 2-1, through which the small diameter portion 1-2 from the swash plate 1-1 extends. The wobble plate 2 is formed with a substantially semi-spherical seat portion 2-2, on which a ball 3 is slidably seated. Furthermore, a socket 4 is connected to the cylinder block 22, and is formed with a substantially semi-spherical recess 4-1, to which the ball 3 is partly seated. The socket 4 is formed with notches 4-2, which can be engaged with corresponding notches on the wobble plate 2, thereby allowing a rocking movement of the wobble plate 2. The small diameter shaft 1-2 is extended through the ball 3 as well as the socket 4. A rotating movement from the not shown crankshaft of the internal combustion engine is applied to the rotating shaft 1, i.e., the swash plate 1-1. The rotating movement of the swash plate 1-1 about the axis L of the shaft 1 causes the wobble plate 2 to be rocked about an axis M of the ball 3, which extends transverse to plane of the paper of FIG. 1.

As shown in FIG. 2, the cylinder block 22 is formed with seven circumferentially and equiangularly spaced cylinder bores 22-1, each of which extends axially as shown in FIG. 1. The cylinder bores 22-1 are opened to the swash plate chamber B. Pistons 5 are axially, reciprocately and slidably inserted to the respective cylinder bores 22-1, so that piston chambers Sp are created in the cylinder bores between the respective pistons 5 and the valve seat plate 14. Each of the pistons 5 is, at its end remote from the piston chamber Sp, formed with a boss portion 5-1 having a substantially semi-spherical recess 5-2. The wobble plate 2 is formed with seven circumferentially and equiangularly spaced substantially semi-spherical recess 2-3. A set of seven circumferentially spaced piston rods 6 are provided, each of which has a first end 6-1 of a substantially spherical shape, which is seated in the corresponding seat 2-3 of the wobble plate 2, and a second end 6-2 of a substantially spherical shape, which is seated in the seat 5-2 of the corresponding piston 5. Thus, the rocking movement of wobble plate 2 about the axis M causes the piston 5 to be axially reciprocated in the respective cylinder bores 22-1. When a piston 5 is moved in a direction toward the valve seat plate 14, the volume of the corresponding piston chamber Sp is reduced, thereby allowing a gas in the chamber to be compressed. Contrary to this, when the piston 5 is moved in a direction away from the valve seat plate 14, the volume of the corresponding piston chamber Sp is increased, thereby allowing a gas to be sucked into the chamber.

In FIG. 1, the valve seat plate 14 is formed with seven circumferentially and equiangularly spaced outlet ports 14-1 which are opened to respective piston chambers Sp. Outlet valves 12 are arranged on one side of the valve seat plate 14 remote from respective piston chambers Sp. A stopper 13 is arranged on one side of each respective outlet valve 12 remote from the valve seat plate 14. Each of the outlet valves 12 is constructed by a resilient plate member, which generates a resilient force, which usually closes a corresponding outlet port 14-1. An outlet chamber F is formed on one side of the outlet valve 12 remote form the valve seat plate 14. The outlet chamber F is connected to a condenser in the refrigerating cycle. The pressure in the piston chamber Sp, which is larger than the resilient force, causes the outlet valve 12 to be displaced from the valve seat plate 14, which allows the compressed gas in the piston chamber Sp to be discharged into the outlet chamber F via the outlet port 14-1.

The cylinder block 22 is formed with a stepped cylindrical bore 22-2, which extends axially. A spool 9 is slidably inserted to the cylinder bore 22-2, so that an intermediate pressure chamber E is formed on one side of the spool 9 in the cylinder bore 22-2, and an intake chamber C is formed on the other side of the spool 9. The chamber C is connected to an evaporator (not shown) in a refrigerating system for receiving a gaseous refrigerant from the evaporator. Thus, the chamber C is under a pressure which corresponds to an intake pressure of the gas. In other words, a pressure corresponding to the pressure in the chamber C is always applied to the right-handed side of spool 9 in FIG. 1. Namely, no means is provided for modifying the intake pressure and for making the modified pressure to be applied to the spool, which makes the system according to the present invention simple.

A gap is provided, in the socket member 4 and it provides communication between the intermediate pressure chamber A and the swash plate chamber B. As a result, a gas leaking through the sliding clearance between the piston 5 and the cylinder bore 22-1 due to the high pressure of the gas in the piston chamber Sp is introduced into the swash plate chamber B. The gas in the chamber B is, then, introduced into the intermediate chamber A via the gap between the socket member 4 and the cylinder bore 22-2. The intermediate pressure A is under an intermediate pressure which is higher than the intake pressure at the intake pressure chamber C.

As shown in FIG. 1, the rear casing 23 is formed with a central boss portion 23-1 defining an inner axial opening which is opened to the intake chamber C, on one hand, and is connected to a pipe (not shown), on the other hand. The pipe is located in a refrigerant gas circuit, and is for introducing a gas evaporated at an evaporator (not shown) into the intake pressure chamber C of the compressor.

As shown in FIG. 2, the cylinder block 22 is formed with seven circumferentially and equiangularly spaced intake ports D. The intake ports D are, at their first ends, opened to the respective piston bore 22-1, while the intake ports D are, at their second ends, opened to the central bore 22-2 for slidably receiving the spool 9 as shown in FIG. 1. The spool 9 function to vary the duration of the communication of the intake ports D with the respective piston chambers Sp, i.e., the amount of the gas introduced into the chambers corresponding to the compression capacity of the compressor.

Figure 5:
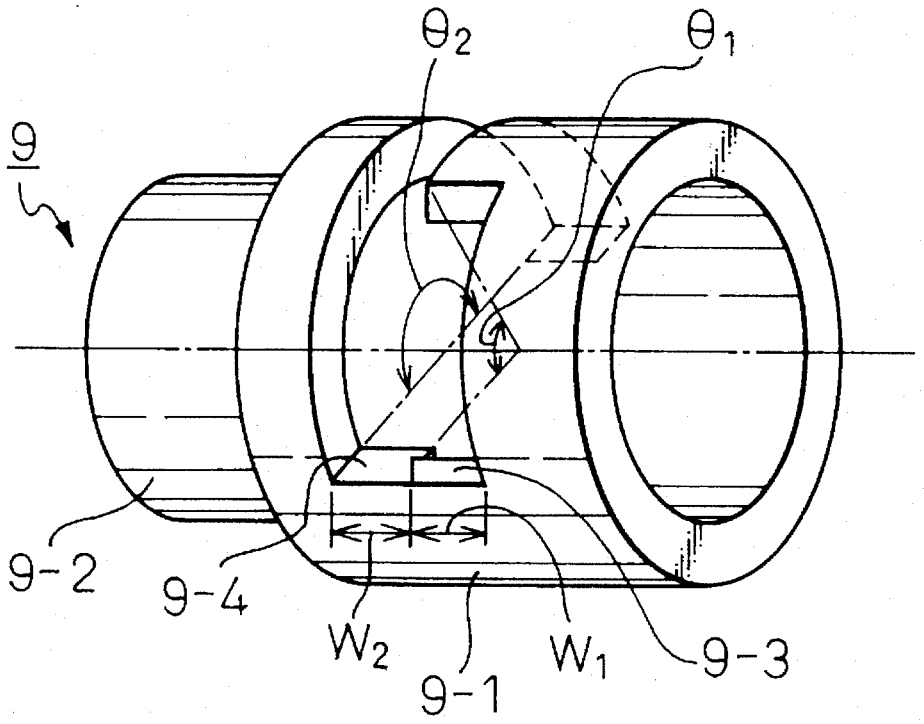
FIG. 5 is a schematic perspective view of a spool in the swash compressor in FIG. 1.

The spool 9 is formed with an axial bore which is slidably inserted to the shaft 1-2. At the inner surface of the axial bore, the spool 9 is formed with an axial groove 9-5, while a key 8 is fixedly connected to the shaft 1-2 and is fitted to the axial groove 9-5. As a result, an axial slidable connection is obtained between the rotating shaft 1-2 and the spool 9, while the rotating movement of the shaft 1-2 is transmitted to the spool 9. The spool 9 is made of metal material such as a steel or aluminum which is coated with a coating for increasing its wear-resistant properties. As shown in FIG. 5, the spool 9 is constructed by a large diameter portion 9-1 of sleeve shape and a small diameter portion 9-2 which extends integrally from the large diameter portion 9-1 toward the swash plate 1-1. The large diameter portion 9-1 is slidably contacted with the inner cylindrical wall of the bore 22-2, so that, on one side of the large diameter portion 9-1 away from the small diameter portion 9-2, the intake pressure chamber C is formed.

As shown in FIG. 5, the large diameter portion 9-1 is formed with a first recess 9-3 of an axial width $W_1$, extending circumferential direction for an angle of $\theta_1$ and a second recess 9-4 of an axial width $W_2$, axially adjacent the first recess 9-3, and extending circumferential direction for an angle of $\theta_2$. The value of the angle $\theta_1$ of the circumferential extension of the first recess 9-3 is for obtaining a fraction of duration (angle) of communication of the intake chamber C with the intake port D in a full intake stroke (180 degree) of a corresponding piston such that only a partial amount of gas, which is, for example, 3 to 5% with respect to the full amount of the gas, is introduced into the corresponding piston chamber Sp. Contrary to this, the angle $\theta_2$ of the circumferential extension of the second recess 9-4 is for obtaining a full duration of communication of the intake chamber C with the intake port D in a full intake stroke (180 degree) of a corresponding piston such that the full amount of gas is introduced into the corresponding piston chamber Sp. Namely, the rocking movement of the wobble plate 2 caused by the rotating movement of the swash plate 1-1 causes the pistons 5 to be reciprocated. A reciprocation of one cycle of a piston 5 is obtained by a full rotation (360 degree) of shaft 1. However, a phase difference of 360/7 degree exists between the intake strokes of adjacent pistons. Thus, an angular arrangement of the second recess 9-4 is such that the second recess 9-4 is in the communication with each of the intake ports D during a full period (180 degree) of the intake stroke of the corresponding piston 5. Namely, during a full (360 degree) rotation of the spool 9, the recess communicates, in sequential manner, with the circumferentially and equiangularly spaced intake ports D, so that the gas in the intake chamber C is distributed to the piston chambers Sp.

As shown in FIG. 1, a compression spring 10 is arranged between an axial end surface of the spool 9 and a faced inner surface of the rear casing 23 in the intake chamber C, so that a resilient force is generated for urging the spool 9 in a direction toward the swash plate 1-1, so that the spool 9 is, by means of the key 8 guided by the groove 9-5, axially slid to an axial position, where the spool 9 is contacted with a stopper 15 constructed as a snap ring fitted to an annular groove on the shaft portion 1-2. At this axial position of the spool 9, the first recess 9-3 is able to communicate with the intake ports D of the respective piston chambers Sp. In place of the provision of the stopper 15, a shoulder portion 15*a* in the central bore 22-2 can be provided so that it functions as the stopper.

Now, an operation of the first embodiment of the present invention will be explained. A rotational movement from an internal combustion engine is applied to the swash plate 1-1 of the rotating shaft via a clutch (not shown) under the engaged condition. As a result, the wobble plate 2, which is in contact with the swash plate 1-1, effects a locking movement about the axis M extending transverse to the axis of the shaft 1 without being rotated due to the provision of the ball 3 and the socket 4. The locking movement of the wobble plate 2 causes the piston rods 6 to be reciprocated, which causes the pistons 5 to be reciprocated in the respective cylinder bores 22-1 in the axial direction. As a result of the reciprocated movement of the pistons 5 in the corresponding cylinder bores 22-1, volumes of the corresponding piston chambers Sp are varied, thereby executing the compression operation of the gas in the piston chambers Sp.

Figure 3B:
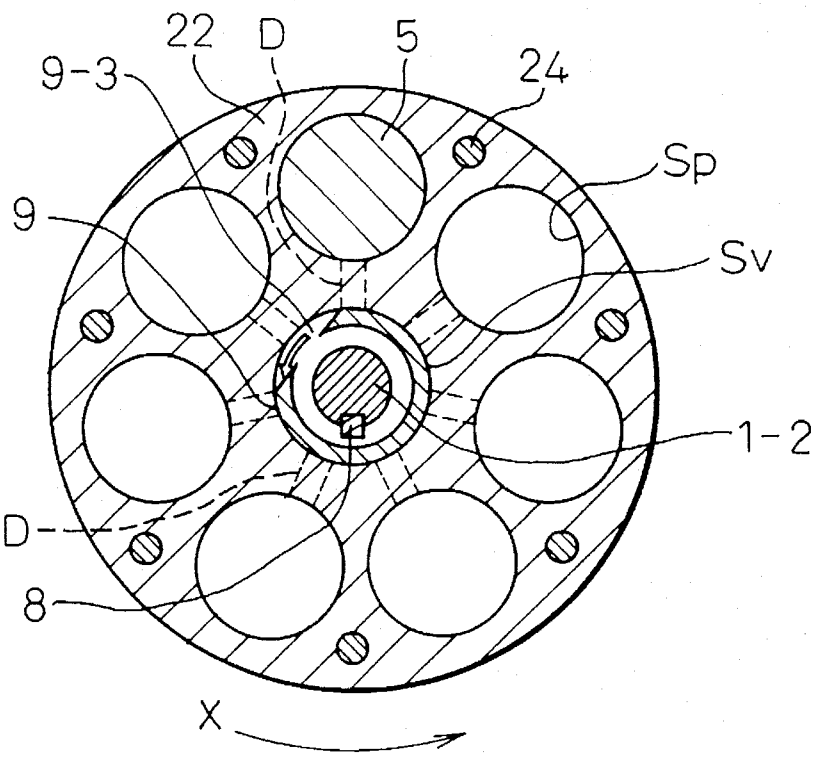
FIG. 3B is similar to FIG. 3A but illustrates when the engagement of a recess of a spool with an intake port is ended.
Figure 3A:
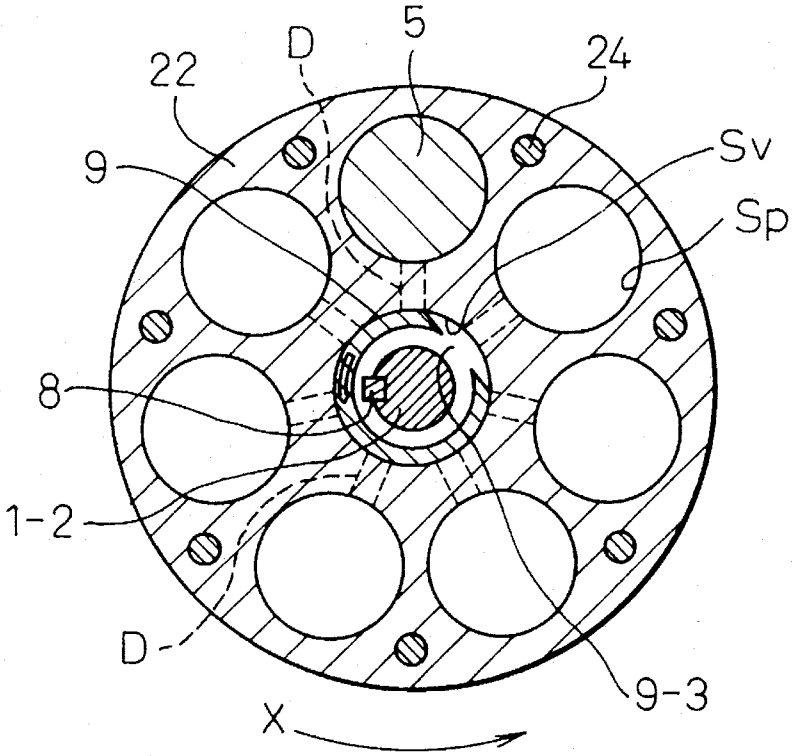
FIG. 3A is a transverse cross-sectional view along a line III—III in FIG. 1, when the engagement of a recess of a spool with an intake port commences during an intake stroke of a piston under a reduced capacity position of the compressor when the operation of the compressor is started.
Figure 6A:
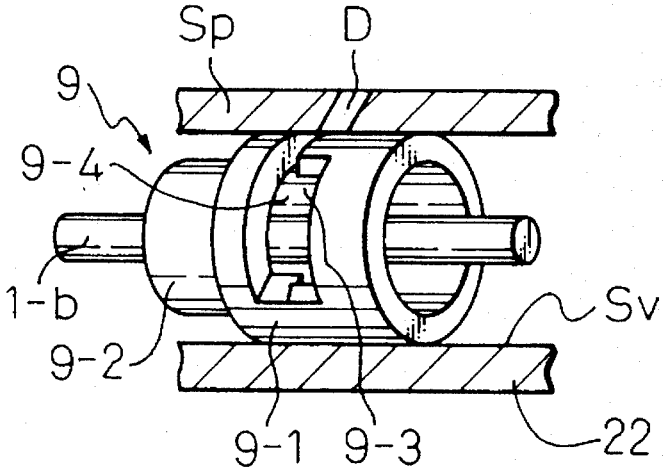
FIG. 6A is a schematic perspective view of the spool with reference to an intake port when the compressor is in a reduced capacity state and is being brought into an operation.

When the compressor is started, the pressure at the piston cylinders Sp cannot be high. As a result, the pressure at the intermediate pressure chamber A is low enough to cause it to be equalized with the pressure at the intake chamber C. As a result, the force of the spring 10 causes the spool 9 to be moved forwardly until the spool 9 is contacted with the stopper 15, so that the spool 9 takes a position as shown in FIG. 6A, where the communication of the intake port D with the each of the piston chambers Sp occurs via the first recess 9-3 extending circumferentially for an angle $\theta_1$, which is for obtaining a capacity which corresponds to a predetermined percent such as 3 to 5% with respect to the full capacity which corresponds to the volume of the piston chamber when the corresponding piston 5 is at its bottom dead center. Namely, FIG. 3A shows the piston 5, shown by shaded lines, at a top dead center, where the piston 5 is located most adjacent the valve seat plate 14 and where the first recess 9-3 of the spool 9 commences its communication with the corresponding intake port D, while the spool 9 is rotated as shown by an arrow X, so that an introduction of the refrigerant into the piston chamber Sp is started. FIG. 3B shows a condition where, from the condition in FIG. 3A, a rotation of the spool 9, i.e., the rotating shaft 1 of an angle of $\theta_1$ is completed, so that the communication of the first recess 9-3 with the corresponding intake port D is finished.

In view of the above, the spool 9 is in the reduced capacity position as shown in FIG. 6A when the compressor is not operated. As a result, when the compressor is started by an engagement of the clutch (not shown) for connecting the drive shaft 1 with a crankshaft of an internal combustion engine, the engine is not given a large load, thereby preventing a shock from being generated in a vehicle body.

Figure 6B:
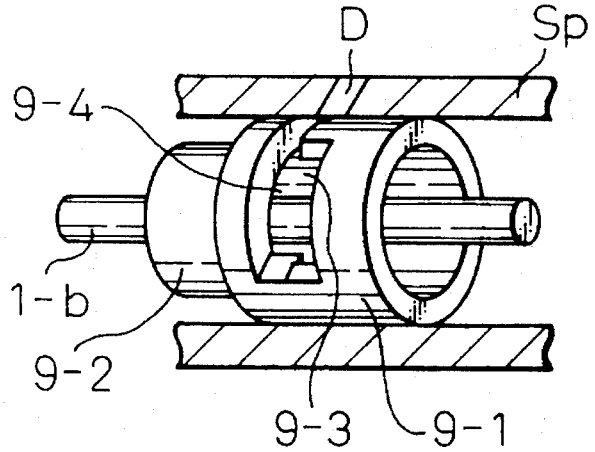
FIG. 6B is similar to FIG. 6A but the spool is in a transient state to a full capacity position.

The commencement of the compression operation of the compressor by the reciprocating movement of the piston 5 causes the pressure at the intermediate pressure chamber A to be gradually increased due to the fact that the gas in the piston chamber Sp leaks into the intermediate pressure chamber A via the swash plate chamber B. The increase in the pressure at the intermediate chamber A causes the spool 9 to be moved in a direction toward the rear casing 23 against the force of the spring 10. FIG. 6B shows the relative positions of the intake port D and the spool 9 when the increase in the pressure at the intermediate pressure chamber A is medium. At this position of the intake port D and the spool 9, the intake port D is partly opened to the second recess 9-4 of a circumferential extension of 180 degrees, while the remaining part of the intake port D is still opened to the first recess 9-3 of the reduced circumferential extension. As a result, a relatively increased compression capacity of the compressor is obtained during a transient state from the initial position of the spool 9 in FIG. 6B.

Figure 4B:
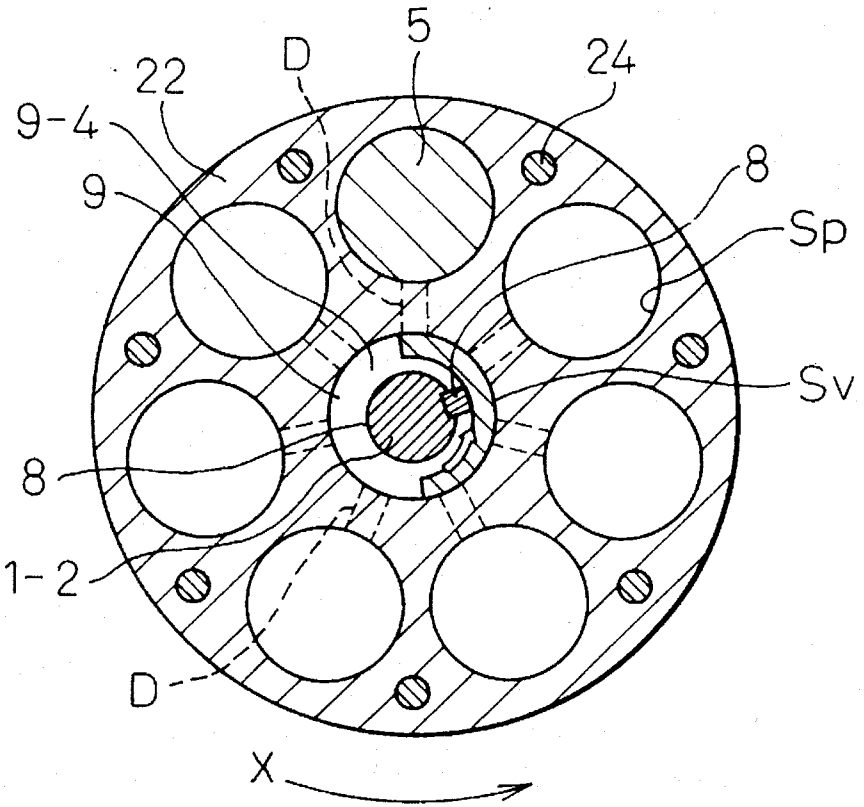
FIG. 4B is similar to FIG. 4A but illustrates when an engagement of a recess of a spool with an intake port is ended.
Figure 4A:
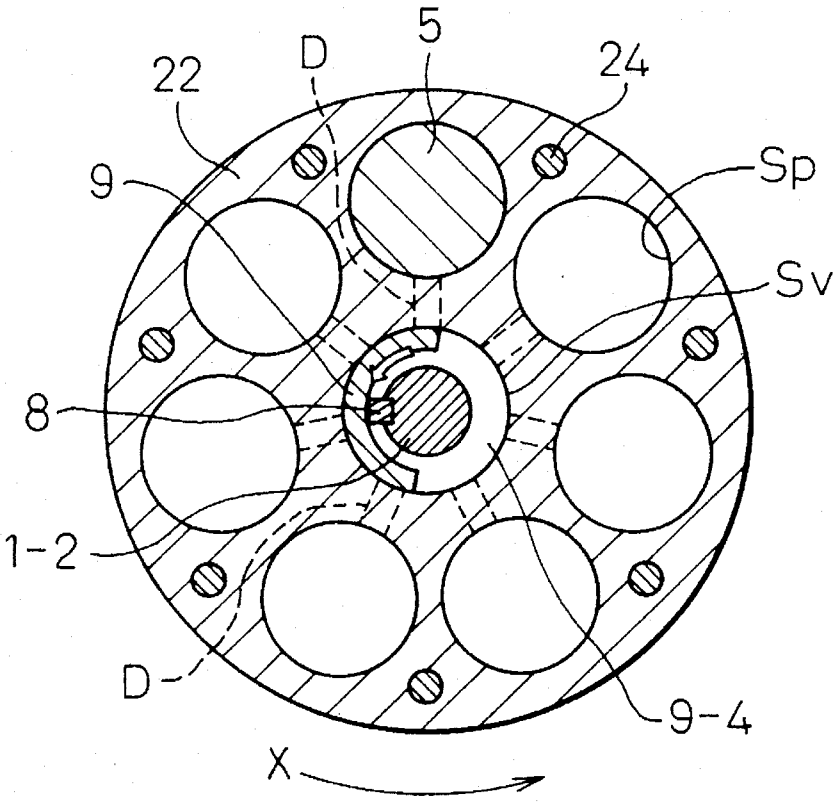
FIG. 4A is similar to FIG. 3A but illustrates when the compressor is in a full capacity condition.
Figure 6C:
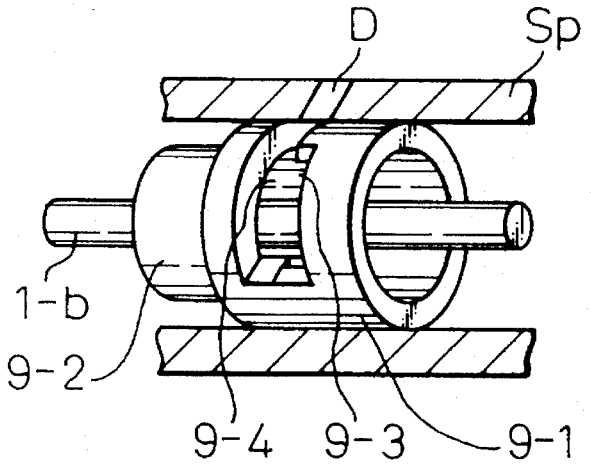
FIG. 6C shows when the spool is in the full capacity position.

When a short time has elapsed after the commencement of the operation of the compressor, the pressure at the intermediate pressure chamber A is finally increased to a level at which the spool 9 is moved to a position where the relative positions of the intake port D and the spool 9 as shown in FIG. 6C are obtained, so that the communication of the intake port D with the each of the piston chambers Sp occurs via the second recess 9-4 extending circumferentially for an angle $\theta_2$, which is equal to 180 degrees and is for providing full capacity. Namely, FIG. 4B shows the piston 5, shown by shaded lines, at its top dead center, where the piston 5 is located most adjacent the valve seat plate 14 and where the second recess 9-4 of the spool 9 commences its communication with the corresponding intake port D, while the spool 9 is rotated as shown by an arrow X, so that an introduction of the refrigerant into the piston chamber Sp is started. FIG. 4B shows the condition where the piston 5, shown by shaded lines, is at its bottom dead center, and where, from the condition in FIG. 4B, a rotation of the spool 9, i.e., the rotating shaft 1 of an angle of $\theta_2$, which is equal 180 degrees, is completed, so that the communication of the second recess 9-4 with the corresponding intake port D is finished.

As explained above, according to the present invention, the engagement of the clutch between the compressor and the crankshaft allows the pressure at the intermediate pressure chamber A to be gradually increased, i.e. the spool 9 to be gradually moved from the reduced capacity position to the full capacity position. As a result, a gradual and smooth increase in the compression torque is obtained after the engagement of the clutch and until the pressure at the intermediate pressure chamber is fully increased. As a result, an occurrence of a shock when the operation of the compressor is commenced is suppressed when compared with the prior art construction where 100% compression is instantly commenced when the clutch is engaged.

Furthermore, in comparison with the construction in the Japanese Unexamined Patent Publication No. 5-306680, the spool 9 according to the present invention is operated only when the operation of the compressor is commenced, thereby reducing an occurrence of a shock. Thus, the reduced compression as small as 3 to 5% with respect to the full compression capacity is sufficient for attaining this purpose. Since the compression capacity reduction according to the present invention occurs only when the operation of the compressor commences, the reduced compression capacity as small as 3 to 5% does not cause the lubrication to be insufficient at the compressor. Thus, according to the present invention a desired lubrication performance as well as a reduction of a shock when the compressor is brought into operation, which are contradictory to each other, can be attained.

When the clutch is de-energized, the compressor is stopped. In this case, the pressure at the intermediate chamber A is reduced, so as to be equalized with the pressure at the intake chamber C. Thus, the spring 10 again urges the spool 9 in a forward direction until it is contacted with the stopper 15, thereby obtaining a reduced compression capacity position, as shown in FIG. 6A, for the following commencement of the operation of the compressor.

Figure 7:
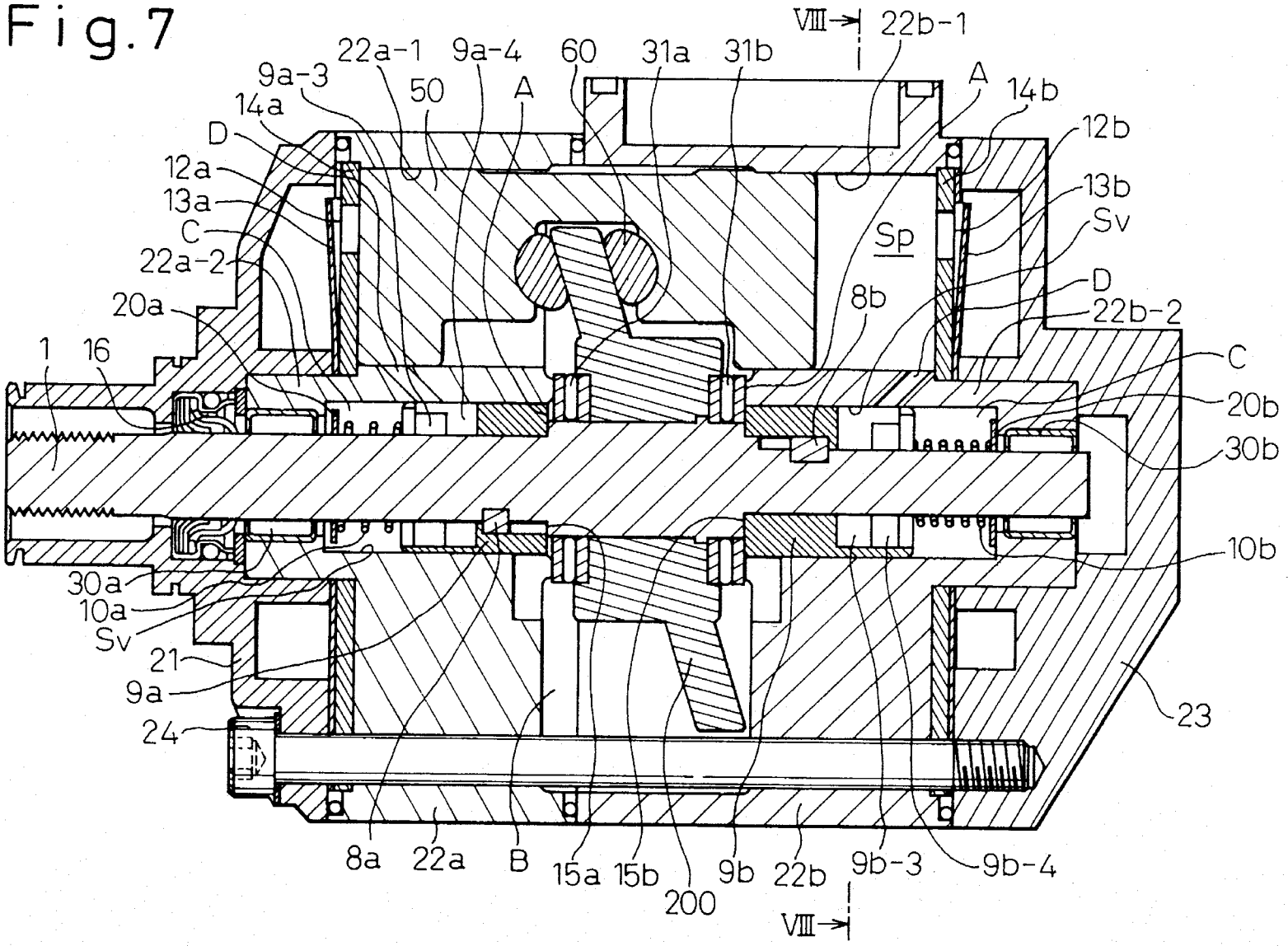
FIG. 7 is a longitudinal cross-sectional view of a swash compressor according to a second embodiment of the present invention.
Figure 8:
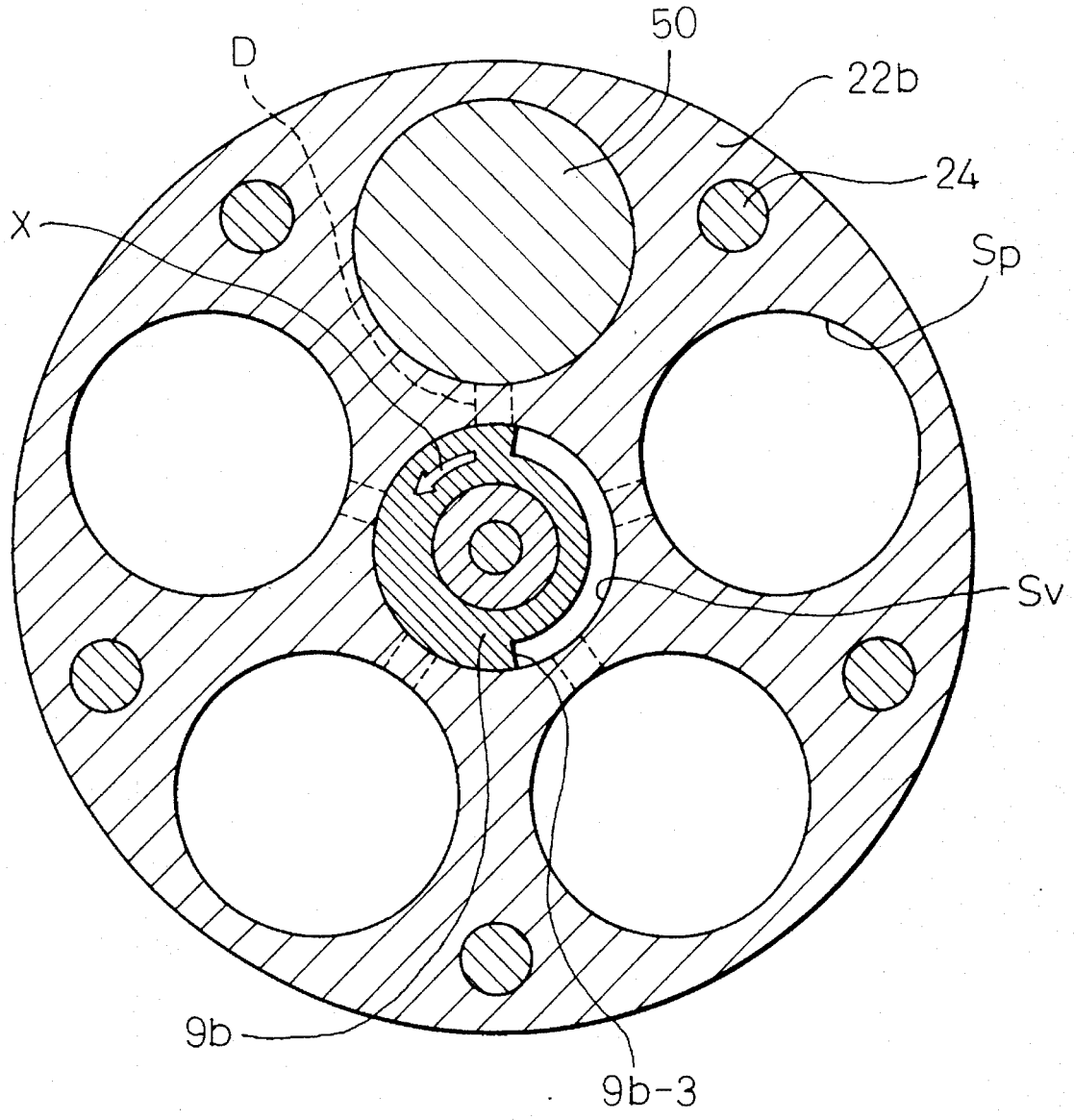
FIG. 8 is a transverse cross-sectional view along a line VIII—VIII in FIG. 7.

FIGS. 7 and 8 show a second embodiment, where the present invention is applied to a swash compressor of a double headed piston type, where pistons are arranged on both sides of a swash plate. Namely, a swash plate 200 is connected to a rotating shaft 1, which is in connection with a crankshaft of an internal combustion for a vehicle via a clutch so that a rotating movement from the crankshaft is transmitted to the rotating shaft 1. Cylinder blocks 22*a* and 22*b* are under an axially face to face arrangement and connected with each other by means of equiangularly spaced and circumferentially spaced bolts 24 together with a front casing 21 and a rear casing 23. The rotating shaft 1 is supported by the cylinder blocks 22*a* and 22*b* by means of radial bearings 30*a* and 30*b*, respectively. Furthermore, a thrust bearing 31*a* is arranged between faced surfaces of the cylinder block 22*a* and the swash plate 200, and a thrust bearing 3l*b* is arranged between faced surfaces of the cylinder block 22*b* and the swash plate 200.

The cylinder blocks 22*a* and 22*b* are formed with five equiangularly and circumferentially spaced axially aligned pairs of cylinder bores 22*a*-1 and 22*b*-1. Pistons 50 are axially reciprocately inserted to the cylinder bores 22*a*-1 and 22*b*-1, so that, for each of the pistons 50, piston chambers Sp are formed on its sides respectively. The pistons 50 are connected to the swash plate 200 via respective pairs of shoes 60 of semi-spherical shape, so that a rotating movement of the swash plate 200 causes the pistons 50 to be axially reciprocated in the respective cylinder bores, which causes the volume of the piston chambers Sp to be varied.

Valve seat plates 14*a* and 14*b* are arranged between the front casing 21 and the cylinder block 22*a* and the rear casing 23 and the cylinder block 22*b*. On the valve seat plates 14*a* and 14*b*, delivery valves 12*a* and 12*b* (reed valves) and valve stoppers 13*a* and 13*b* are arranged. These valves 12*a* and 12*b* and stoppers 13*a* and 13*b* have central bores, to which step shaped boss portions 22*a*-2 and 22*b*-2 are inserted, respectively, so that the parts 12*a* and 12*b* and 13*a* and 13*b* are made integral to the cylinder blocks 22*a* and 22*b* as well as the front and rear casings 21 and 23, when the bolts 24 are tightened.

Spools 9*a* and 9*b*, which function as rotary valves, are axially slidably connected to the rotating shaft 1 by means of keys 8*a* and 8*b*, respectively, while the spools 9*a* and 9*b* are rotated integrally with the rotation of the rotating shaft 1. Coil springs 10*a* and 10*b* have first ends resting on circlips 20*a* and 20*b*, respectively, and second sends abutting the spools 9*a* and 9*b*, so that the spools 9*a* and 9*b* are moved axially toward each other, so that the spools 9*a* and 9*b* contact stoppers 15*a* and 15*b* as shoulders formed on the shaft 1. Intermediate pressure chambers A are formed on the sides of the spools 9*a* and 9*b* spaced from the springs 10*a* and 10*b*, respectively. The intermediate pressure chambers A are in communication with a swash plate chamber B. Intake pressure chambers C are formed on sides of spools 9*a* and 9*b* adjacent the springs 10*a* and 10*b*, respectively. The spool 9*a* is formed with a first recess 9*a*-3 of a small circumferential extension for an angle $\theta_1$, and a second recess 9*a*-4 of a large circumferential extension for an angle $\theta_0$, as explained with reference to FIG. 5. Similarly, the spool 9*b* is formed with a first recess 9*b*-3 of a small circumferential extension for an angle $\theta_1$, and a second recess 9*b*-4 of a large circumferential extension for an angle $\theta_2$.

When the compressor is at rest, the pressure at the intermediate pressure chamber A and the pressure at the intake pressure chambers C are equalized. As a result, the spools 9*a* and 9*b* take positions where the spools 9*a* and 9*b* connect with stoppers 15*a* and 15*b*, respectively. In this case, the axial positions of the spools 9*a* and 9*b* are such that the piston chambers Sp are in communication with the intake pressure chamber C via the first recess 9*a*-3 and 9*b*-3 of smaller circumferential extension $\theta_1$, respectively. Thus, the small compression capacity causes the load applied to the engine to be reduced when the compressor is brought into an operation, thereby reducing shock. After the commencement of the operation of the compressor, a gradual increase is obtained in pressure at the intermediate pressure chambers A due to the leakage of the gas from the piston chambers Sp via the swash plate chamber B, so that the spools 9*a* and 9*b* are moved away from each other against the force of the springs 10*a* and 10*b*, respectively. As a result, the spools 9*a* and 9*b* are finally moved to positions where the communication of the piston chambers Sp and the respective intake chambers C occurs via the second recess 9*a*-4 and 9*b*-4 of larger circumferential extension $\theta_2$. As a result, the full compression capacity of the compressor is obtained.

Figure 9:
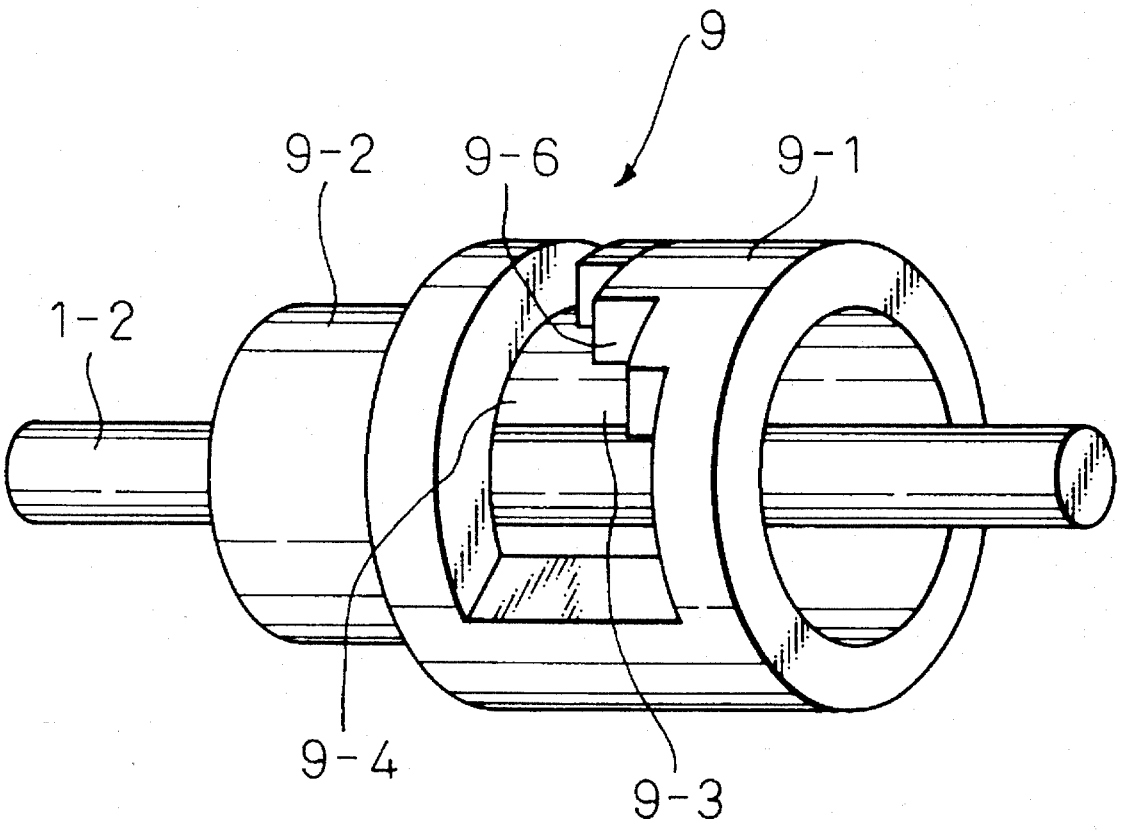
FIG. 9 is similar to FIG. 5 but illustrates a modification of a spool.

FIG. 9 illustrates a modified embodiment of the present invention, where a spool 9 has, in addition to the first and second recess 9-3 and 9-4, an additional recess 9-6 which is located between the first and second recess 9-3 and 9-4. The additional recess 9-6 has a circumferential extension which is larger than that of the first recess 9-3 and is smaller then that of the second recess 9-4. Thus, an intermediate value of the compression capacity between the minimum compression capacity corresponding to the circumferential extension of the first recess 9-3 and the full compression capacity corresponding to the circumferential extension of the second recess 9-3 is obtained. Thus, a more sophisticated control of the compression capacity, when the compressor is brought into operation, is obtained.

In the present invention, in place of the stepped shape of the recess 9-3 and 9-4 of the spool 9, a continuous tapered shape of the recess can be employed. In this case, a continuous increase in the compression capacity is obtained after the commencement of the operation of the compressor.

The above embodiment is directed to the situation where the compressor is driven by a crankshaft of an internal combustion engine via an electromagnetic clutch. The present invention can be employed for a case where the compressor is driven by an independent, auxiliary engine as is the case for an air conditioning system for a larger vehicle, such as a bus.

We claim:

1. A swash plate compressor for compressing a gas, said swash plate compressor comprising:

a piston axially slidably inserted into a cylinder bore to form a piston chamber;

a swash plate fixedly connected to a rotating shaft so as to be rotatable therewith, said swash plate cooperating with said piston so that rotating movement of said swash plate causes said piston to be axially reciprocated in said cylinder bore;

a swash plate chamber storing said swash plate;

an intake chamber for receiving gas to be compressed;

an intake port connecting said intake chamber with said piston chamber;

a pressure responsive reciprocating spool valve connected in rotation with said rotating shaft between said intake chamber and said swash plate chamber, said spool valve being axially slidable with respect to said rotating shaft, said spool valve including:

a fractional stroke recess for allowing said intake port to communicate with said intake chamber for only a fraction of an intake stroke of said piston, and a full stroke recess for allowing said intake port to communicate with said intake chamber for a full intake stroke of said piston;

spring means for urging said spool valve toward a reduced compression position wherein said fractional stroke recess and not said full stroke recess allows said intake port to communicate with said intake chamber; and a discharge port to discharge said gas when said piston is moved in a discharge direction.

2. A swash plate compressor according to claim 1, wherein said spool valve further includes:

a first cylindrical portion of a first diameter; and a second cylindrical portion of a second diameter smaller than said first diameter;

said fractional stroke recess and said full stroke recess being formed on said first cylindrical portion; and said second cylindrical portion being axially slidably connected to said rotating shaft.

3. A swash plate compressor according to claim 1, wherein:

said fractional stroke recess is connected to said full stroke recess such that said fractional stroke recess is adjacently connected in a step-like manner to said full stroke recess.

4. A swash plate compressor according to claim 1, wherein:

said fractional stroke recess is connected to said full stroke recess such that said fractional stroke recess is adjacently connected in a continuously tapering manner to said full stroke recess.

5. A swash plate compressor according to claim 1, wherein said spool valve further includes:

an intermediate stroke recess for allowing said intake port to communicate with said intake chamber for an intermediate portion of said intake stroke of said piston greater than said fraction of said intake stroke of said piston and less than said full stroke of said piston.

6. A swash plate compressor for compressing a gas comprising:

a casing having at least one cylinder bore;

a rotating shaft rotatably connected to said casing;

a piston axially slidably inserted into each at least one cylinder bore, so that at least one piston chamber is formed by a piston in a cylinder bore;

a swash plate fixedly connected to the rotating shaft, so that the swash plate is rotated together with the rotation of the rotating shaft, the swash plate cooperating with the piston so that the rotating movement of the swash plate causes the piston to be axially reciprocated in the cylinder bore, thereby varying the volume of the piston chamber;

a swash plate chamber in the casing for storing the swash plate;

intake means for introducing the gas into the piston chamber when the piston is moved in a direction for increasing the volume of the piston chamber, and;

discharge means for discharging the gas when the piston is moved in the opposite direction for decreasing the volume of the piston chamber;

said intake means comprising:

an intake chamber in the casing for receiving the gas to be compressed;

an intake port in the casing for connecting the intake chamber with the piston chamber;

a spool valve which is connected in rotation with the rotating shaft, while being axially slidable with respect to the rotating shaft;

the intake chamber being opened to one side of the spool valve, while, on another side of the spool valve, an intermediate pressure chamber, which is in communication with the swash plate chamber, is formed, and;

a spring for urging the spool valve toward the intermediate pressure chamber;

said spool forming:

a first recess for allowing the intake port to communicate with the intake chamber for a rotating angle corresponding a fraction of an intake stroke of the piston when the spool is moved to a position adjacent the intermediate pressure chamber by the force of the spring due to a low pressure in the intermediate pressure chamber, and;

a second recess for allowing the intake port to communicate with the intake chamber for an rotating angle range corresponding a full intake stroke of the piston when the spool is moved to a position opposite the intermediate pressure chamber against the force of the spring due to a high pressure in the intermediate pressure chamber.

7. A swash plate compressor according to claim 6, wherein:

the piston in the cylinder bore forms said piston chambers on its respective sides, so that the piston chambers are arranged to be astride said swash plate, and wherein said intake means, and discharge means are independently provided for each of the piston chambers.

8. A swash plate compressor according to claim 6, wherein:

said spool includes a first cylindrical portion of a first diameter and a second cylindrical portion of a second diameter smaller than said first diameter, the first and second recess being formed on the first cylindrical portion, the second cylindrical portion being connected to the shaft while being axial slidable.

9. A swash plate compressor according to claim 6, wherein:

said first recess is connected to the second recess, so that respective circumferential extensions are varied in a step-like manner.

10. A swash plate compressor according to claim 6, wherein:

said intake chamber is directly opened to said side of the spool valve.

11. A swash plate compressor according to claim 6, wherein:

the fraction of the intake stroke obtained by the first recess is such that 3 to 5% of the compression capacity of the swash plate compressor is obtained, as compared to the full capacity of the compressor, at the instant when the compressor is brought into operation.

12. A swash plate compressor for an air conditioning device for a vehicle having an internal combustion engine, wherein the compressor is rotated by applying a rotating movement from the engine to the compressor, the compressor comprising:

a casing having at least one cylinder bore;

a rotating shaft rotatably connected to the casing;

a piston axially slidably inserted into each at least one cylinder bore, so that at least one piston chamber is formed by the piston in the cylinder bore;

a swash plate fixedly connected to the rotating shaft, so that the swash plate is rotated together with the rotation of the rotating shaft, the swash plate being in cooperation with the piston so that the rotating movement of the swash plate causes the piston to be axially reciprocated in the cylinder bore, thereby varying the volume of the piston chamber;

a swash plate chamber in the casing for storing the swash plate;

intake means for introducing the gas into the piston chamber when the piston is moved in a direction for increasing the volume of the piston chamber, and;

discharge means for discharging the gas when the piston is moved in the opposite direction for decreasing the volume of the piston chamber;

said intake means comprising:

an intake chamber in the casing for receiving the gas to be compressed;

an intake port in the casing for connecting the intake chamber with the piston chamber;

a spool valve which is connected in rotation with the rotating shaft, while being axially slidable with respect to the rotating shaft;

the intake chamber being opened to one side of the spool valve, while, on another side of the spool valve, an intermediate pressure chamber, which is in communication with the swash plate chamber, is formed, and;

a spring for urging the spool valve toward the intermediate pressure chamber;

said spool forming:

a first recess for allowing the intake port to communicate with the intake chamber for an rotating angle corresponding a fraction of an intake stroke of the piston when the spool is moved to a position adjacent the intermediate pressure chamber by the force of the spring due to a low pressure in the intermediate pressure chamber when the compressor is at rest, and;

a second recess for allowing the intake port to communicate with the intake chamber for an rotating angle range corresponding a full intake stroke of the piston when the spool is moved to a position opposite the intermediate pressure chamber against the force of the spring due to a high pressure in the intermediate pressure chamber when the compressor is under stable operated condition;

the fraction of the intake stroke obtained by the first recess being such that 3 to 5% of the compression capacity of said swash plate compressor is obtained, as compared to a full capacity of said swash plate compressor, at an instant when said swash plate compressor is brought into operation.

* * * * *